United States Patent [19]

Gill et al.

[11] Patent Number: 4,909,817

[45] Date of Patent: Mar. 20, 1990

[54] APPARATUS AND METHOD FOR THE MANUFACTURE OF LOOSE FIBROUS MINERAL MATERIAL

[75] Inventors: Gurdev S. Gill, Heath; Shiv K. Bakhshi, Columbus, both of Ohio

[73] Assignee: Owens-Corning Fiberglas Corporation, Toledo, Ohio

[21] Appl. No.: 306,602

[22] Filed: Feb. 6, 1989

[51] Int. Cl.[4] ..... C03B 37/04

[52] U.S. Cl. ..... 65/8; 65/9; 65/14

[58] Field of Search ..... 65/4.4, 5, 6, 8, 9, 65/14, 15; 53/167, 396

[56] References Cited

U.S. PATENT DOCUMENTS

| | | | |
|---|---|---|---|
| 2,110,280 | 3/1938 | Vieweg | 65/5 |
| 2,172,153 | 9/1939 | McClure | 65/5 |
| 2,904,453 | 9/1959 | Labino | 65/4.4 X |
| 3,616,030 | 10/1971 | Jumentier et al. | 65/4.4 X |
| 3,883,334 | 5/1975 | Cassidy et al. | 65/9 X |
| 3,981,047 | 9/1976 | Contractor et al. | 65/9 X |
| 4,268,294 | 5/1981 | Laughlin et al. | 65/9 X |
| 4,337,074 | 6/1982 | Muschelknautz et al. | 65/5 |
| 4,347,070 | 8/1982 | Levecque et al. | 65/9 |

*Primary Examiner*—Robert L. Lindsay

*Attorney, Agent, or Firm*—Patrick P. Pacella; Ted C. Gillespie; James F. Porcello, Jr.

[57] ABSTRACT

The present invention provides a multi-purpose collection system for use in the simultaneous manufacture of loose fibrous mineral material and insulation blankets or mats from the forming machine. The loose fibrous mineral material is directly intercepted from the fiberizer units of the forming machine and requires no post-processing steps other than separation and packaging.

10 Claims, 4 Drawing Sheets

APPARATUS AND METHOD FOR THE MANUFACTURE OF LOOSE FIBROUS MINERAL MATERIAL

BACKGROUND OF THE INVENTION

This invention relates to the production of mineral fiber material, particularly of such materials as glass fibers. Specifically, the invention relates to making loose fibrous material of a type suitable for the manufacture of fiberglass products and also suitable as loose-fil insulation for blowing into attics of houses for insulation purposes.

In the manufacture of mineral fiber insulation, the mineral fibers are usually formed from molten mineral material using fiberizers. In the typical manufacturing operation the molten mineral material is introduced into a plurality of fiberizers from the forehearth and bushings of melt furnace. The fiberizers centrifuge the molten material and cause the material to be formed into fibers which are directed as a stream or veil to a collection unit.

A common apparatus and method for producing mineral fiber in continuous length blankets, packs or mats is shown in U.S. Pat. No. 4,300,931. In this patent, a stream of fibrous material is directed toward a collection surface and a flow of gases is discharged substantially parallel to the stream of fibrous material so as to expand the stream as it moves toward a collection surface, in this case, a foraminous conveyer. The flow of gases is discharged at a speed sufficiently greater than that of the stream of fibrous material so as to expand the stream as it moves toward the collection surface. Other systems have been known to use an oscillating cylinder resembling an open bottomed bucket to distribute the fibrous material rapidly from side to side of the collection surface, thereby providing relatively even distribution across the width of the insulation pack. These methods and apparatuses for producing insulation blankets or mats of fibrous web are designed such that a whole machine is dedicated to the manufacture of the desired end product.

Another desirable insulation product is loose-fil insulation or fibrous mineral material produced from blowing loose formed wool and bagging the wool without formation into a blanket or mat. U.S. Pat. No. 4,296,164 discloses a current method for the manufacture of such blowing wool. In the patent, the wool is discharged by the fiberizers onto a collection surface such as a conveyer. The resulting wool blanket is then cut or chopped into columns and the columns experience a random break-up during the bagging process. When blown into place as insulation, the columns break further into smaller prisms approximating cubes or flakes of various thicknesses. The machines which are used to manufacture the loose-fil or bagged mineral fiber insulation end product are also dedicated machines.

The need for dedicated machinery in the processes for manufacturing insulation by methods such as that shown in the '931 and '164 patents is the result of the variations in post-processing required to produce the distinct endproducts. The mineral fiber usually needs curing, cooling and drying. In the case of blown wool, additional steps such as cutting, cubing, or the hammermill are required. All of these post-processing steps require plant space for placement of the machinery and energy to operate the machinery. Thus, until the present invention, there has been little flexibility in the end-product choice for a given fiberizer line once the post-processing equipment is in place. The present invention provides the desired flexibility by offering a blown wool insulation manufacturing process and apparatus which directly intercepts the mineral fiber veil leaving the fiberizers and eliminates any need for post-processing. The invention allows a fiberizer line to simultaneously manufacture loose fibrous material for use in the manufacture of mineral fiber products and loose-fil insulation and insulation blankets or mats.

It is an object of this invention to provide an improved method and apparatus for producing loose fibrous mineral material.

It is a further object of this invention to provide a method and apparatus for directly forming loose fibrous mineral material while utilizing the same machine from which continuous mat or batt insulation is manufactured.

Yet another object of this invention is to provide a method and apparatus for producing loose-fil mineral fiber insulation while eliminating the post processing steps employed by various methods of the prior art.

A final object of the present invention is the retrieval of the mineral fibers directly from the mineral fiber veil being produced by the fiberizer and packaging of the mineral fibers for shipping.

SUMMARY OF THE INVENTION

The present invention provides an improved apparatus for use in the direct forming production of loose fibrous mineral material and further provides a method for utilizing the improved apparatus. The present invention provides a gathering member which directly intercepts the mineral fiber veil as it exits from the fiberizer and directs the mineral fibers through a duct to a packaging machine. The present invention eliminates the post fiberizing operations of resin application, curing, cooling, cutting, and drying.

The present invention further provides the flexibility of using one fiberizing machine in a multiproduction manner wherein loose fibrous mineral material can be directly formed from one or more fiberizers while insulation blankets, mats and batts are produced from the remaining fiberizers.

The detailed aspects of the present invention will become readily apparent upon viewing the drawings with reference to the following description of the preferred embodiment of the invention.

DETAILED DESCRIPTION OF THE PREFERRED EMBODIMENT

The present invention is intended to provide for greater versatility of a fiberizing manufacturing station. For the purposes of simplicity and clarity, the invention will be described in terms of glass fiber manufacture, but it is intended that the inventive method and apparatus is applicable as well to the manufacture of any mineral fiber such as rock, slag and basalt.

Figure 1:
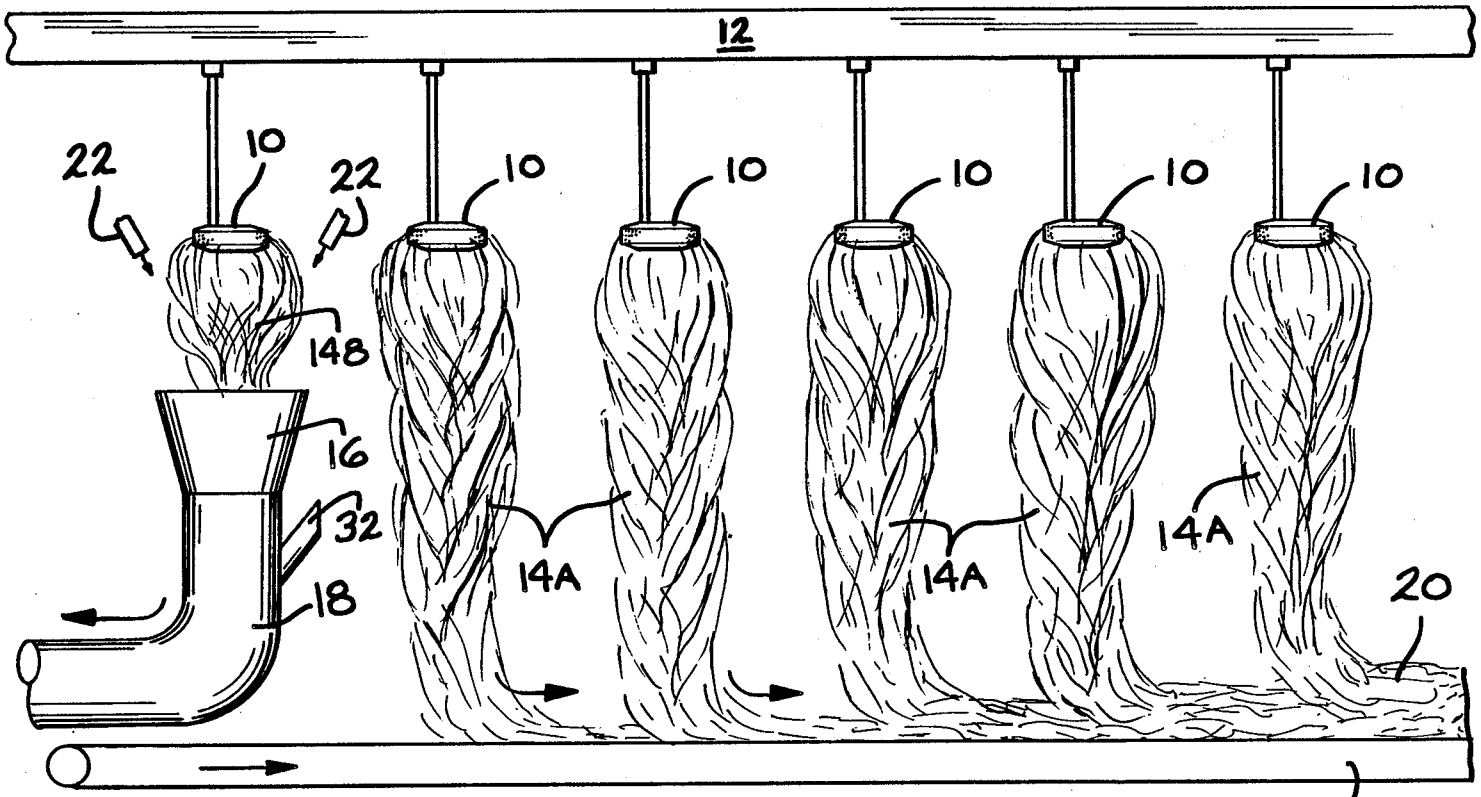
FIG. 1 is a diagrammatic representation of the combined direct loose fibrous mineral material forming and conveyerized insulation blanket forming apparatus of the present invention.

A typical fiberizing station is shown in FIG. 1. A plurality of fiberizers 10 receive molten glass material from a forehearth 12. The fiberizers 10 each produce a veil 14 of glass fibers which are directed downwardly toward a collection member.

Figure 2:
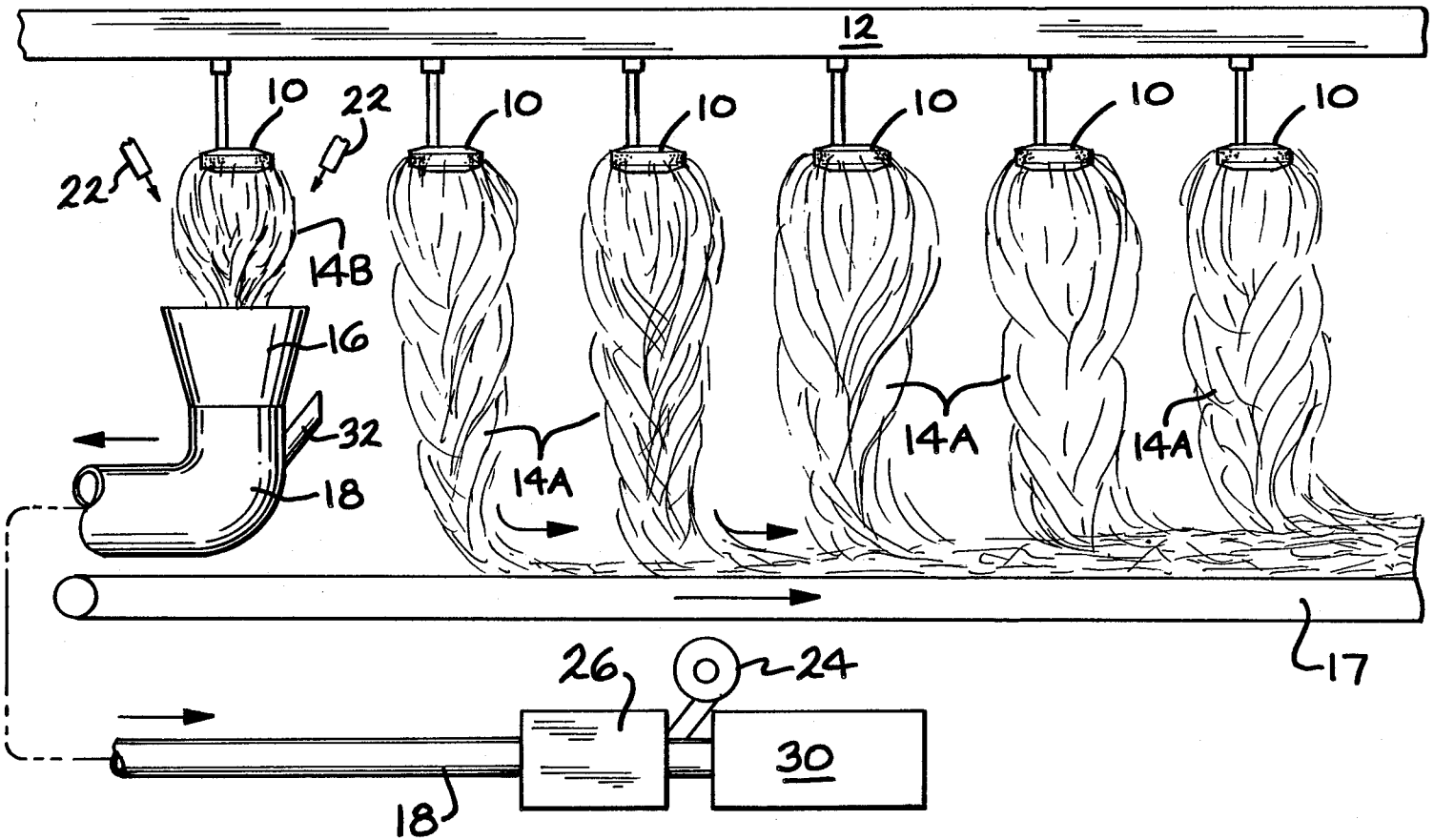
FIG. 2 is a schematic representation of the loose fibrous mineral material manufacturing apparatus of the present invention.

The present invention provides for a dual purpose collection member. The details of the dual purpose collection member of the present invention are shown in FIG. 2. A selected number of fiberizers 10 direct a portion of the glass veils 14A onto a conveyer 17 which gathers the fiber into a continuous blanket or mat 20. The glass veils 14B supplied by the remaining fiberizer(s) 10 are intercepted at a point closely proximate the fiberizer(s) 10, preferably by a cone-shaped gathering member 16. The cone-shaped gathering member 16 diverts the intercepted glass fibers to a duct 18 for transfer to a separator 26 and packaging machine 30. A second conveyer member (not shown) may be used to intercept the veil in lieu of the cone member 16, if design characteristics so warrant.

Sprayers 22 direct an oil emulsion to the downwardly moving glass veil 14B. The oil emulsion is a combination of oil and water provided in a sufficient mixture to enable the emulsion to cool the fibers prior to packaging and, at the same time, reduce the dust level of the operation. Preferably the final glass wool product is about 1% oil by weight. There is no other application of resin, water or other liquid necessary or required by the direct forming operation.

The ratio of the fiberized glass flow, which includes airflow entrained with the glass, into the cone-shaped gathering member 16 and the amount of air moving through the duct 18 is critical in ensuring the smooth flow of glass through the duct 18 as well as ensuring that the end-product is of a cool enough temperature that it can be readily packaged. Outside air is drawn into the duct via a vacuum pump 24. The minimum flow through the duct 18 should be 100 cubic feet per minute for 1 pound of glass fibers and the minimum air velocity in the duct 18 should be at least 3000 feet per minute. If the glass fibers need further cooling for packaging purposed, additional air can be drawn into the duct through the inlet 32. A valve 34 located in inlet 32 can be positioned to regulate the volume of outside air permitted to pass into the duct 18.

Figure 3:
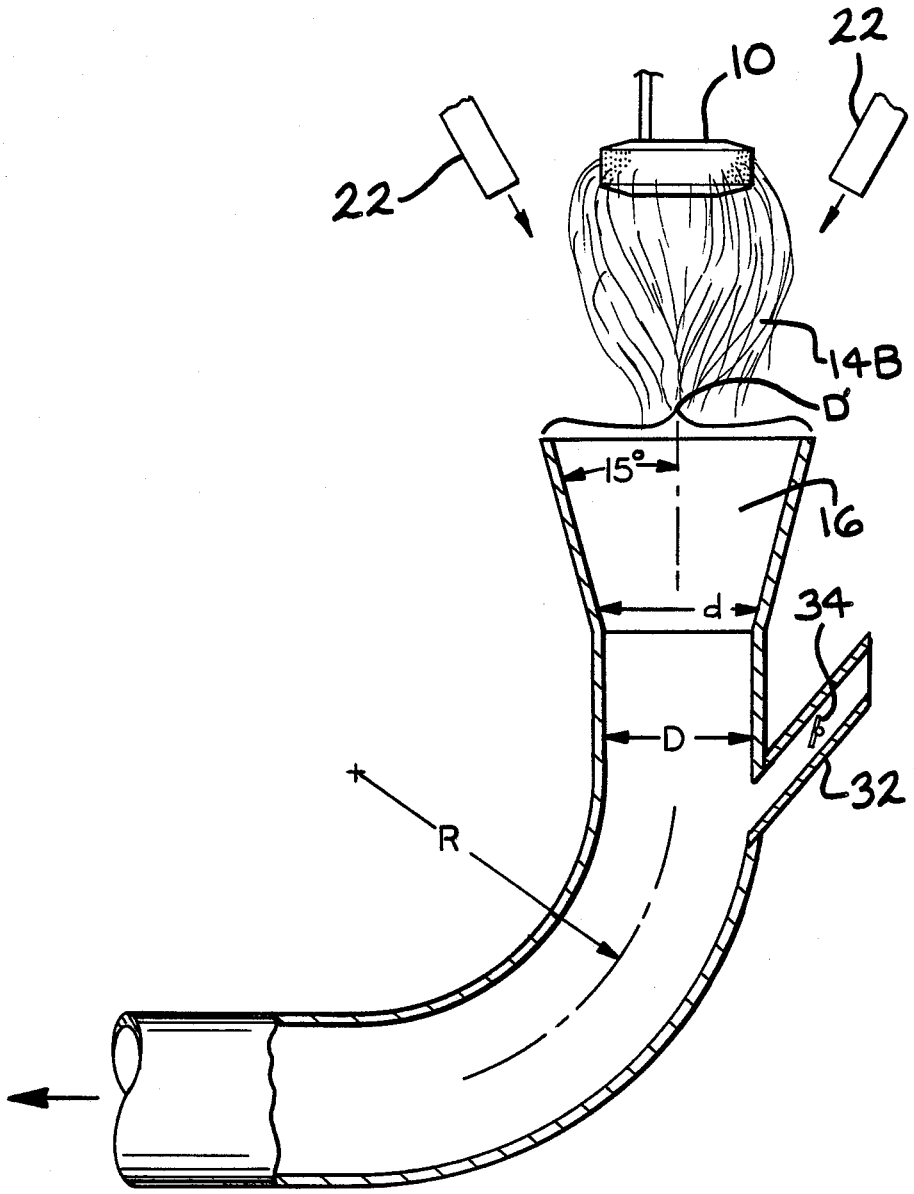
FIG. 3 is a schematic drawing of the preferred gathering member for use in the direct forming method of the present invention.

Further problems arise when attempting to cleanly intercept a rapidly downwardly moving veil 14B. Blowback of the glass fiber occurs when the intercepted glass veil 14B impacts the sides of the cone-shaped gathering member 16 and is reflected back into the downwardly moving veil 14B. The cone-shaped gathering member 16 and duct 18 can be designed to overcome the blowback condition, as shown in FIG. 3. Referring now to FIG. 3, the sides of the cone-shaped gathering member 16 preferably form an angle of about 15° off the axial centerline of the cone member 16 and may fall within the range of 10°–25°. Also the radius of curvature for any curves in the duct 18 must be at least 2.5 times the diameter D of the duct. Further, the cone-shaped gathering member is designed so that the inlet D', the large diameter of the cone-shaped gathering member 16 is at least twice the diameter of the centrifuge member of the fiberizer 10. The outlet d, the small diameter of the gathering member 16, is designed to be approximately the same size as the centrifuge member of the fiberizer 10.

Figure 4:
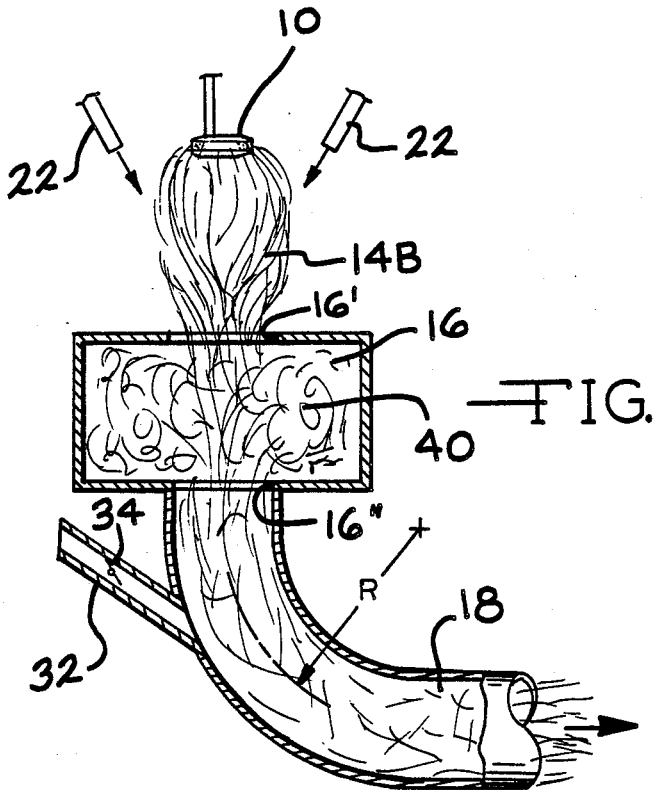
FIG. 4 is a schematic drawing of an alternative embodiment of a gathering member for use in the direct forming method of the present invention.
Figure 5:
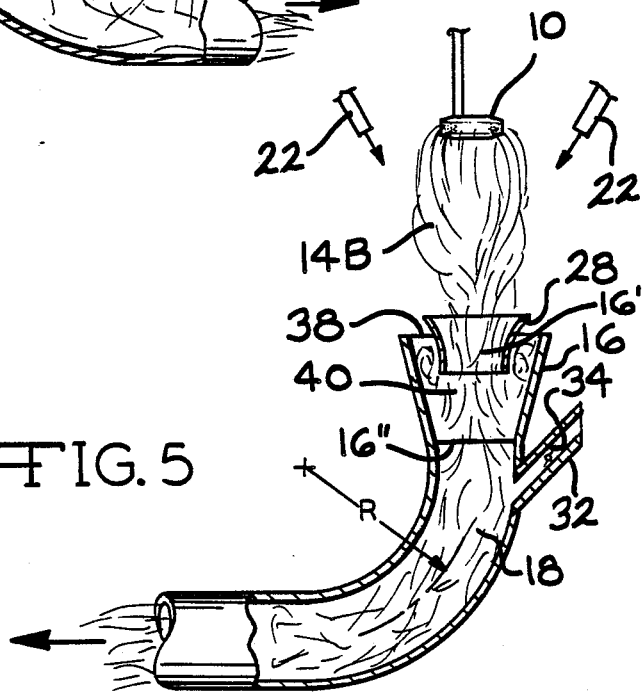
FIG. 5 is a schematic drawing of another alternative embodiment of a gathering member for use in the direct forming method of the present invention.

FIGS. 4 and 5 show alternative embodiments of a gathering member designed to intercept the glass veil 14 and prevent blowback of any glass fibers into the veil 14B.

FIG. 4 shows a gathering member 16 having a substantially rectangular or box-like shape. The rectangular-shaped gathering member 16 includes an inlet 16' which accepts the downwardly moving glass veil 14B. Any potential blowback of glass fibers is contained within the interior or blowback chamber 40 located between the inlet 16' and the outlet 16'' of the rectangular-shaped gathering member 16.

In FIG. 5, a cone-shaped gathering member 16 is partially enclosed about its top portion 38, thereby forming a blowback chamber 40 between its inlet 16' and it outlet 16''. The inlet 16' includes a funnel member 28 extending outwardly from the top portion 38 of the gathering member for collecting the downwardly moving glass veil 14B.

The above description of the preferred embodiments of the methods and apparatus of this invention is intended to be illustrative in nature and is not intended to be limiting upon the scope and content of the following claims.

We claim:

1. A method for manufacturing loose fibrous mineral material comprising the steps of:

centrifuging molten mineral material in a fiberizer member thereby creating a downwardly moving veil of mineral fibers;

intercepting such veil with a cone-shaped gathering member, the walls of said gathering member defining an angle within the range of from about 10° to 25° from the axial centerline of said gathering member, wherein such angular walls of said gathering member act to absorb the energy of such downwardly moving veil to prevent reflection of such intercepted mineral fibers back into such downwardly moving veil;

directing such veil from such gathering member into a duct;

conveying such mineral fibers through such duct to a packaging machine; and, packaging such mineral fibers.

2. The method of claim 1, further including the step of changing the direction of flow of such mineral fibers after directing such fibers into a duct by moving such fibers through a curve in the duct wherein the radius of curvature of such duct is greater than or equal to 2.5 times the diameter of such duct.

3. The method of claim 1, wherein said intercepting step further includes the step of absorbing the energy of such downwardly moving veil within such cone-shaped member by means of a blowback chamber located within such cone-shaped member.

4. A method for manufacturing loose fibrous mineral material comprising the steps of:

centrifuging molten mineral material in a fiberizer member thereby creating a downwardly moving veil of mineral fibers;

intercepting such veil with a gathering member having a blowback chamber for absorbing the energy of such downwardly moving veil to prevent reflection of such intercepted mineral fibers back into such downwardly moving veil and controlling the flow of such mineral fibers into a transfer duct;

transferring such mineral fibers through such duct to a separator for removing air from such mineral fibers and then to a packaging machine; and, packaging such mineral fibers.

5. A method for manufacturing loose fibrous mineral material comprising the steps of:

establishing a flow of molten mineral material from a furnace and directing a major portion of the flow of molten mineral material to a plurality of fiberizers and centrifuging mineral fibers from such plurality of fiberizers to form an insulation pack;

directing the remaining portion of the flow of molten mineral material to at least one auxiliary fiberizer and centrifuging mineral fibers from such auxiliary fiberizer to create a downwardly moving veil of mineral fibers;

intercepting such veil with at least one gathering member which is adapted to absorb the energy of such downwardly moving veil to prevent reflection of such intercepted mineral fibers back into such downwardly moving veil and direct such mineral fibers into a duct;

conveying such mineral fibers through such duct to a packaging machine; and, packaging such fibers.

6. An apparatus for the manufacture of loose fibrous mineral material comprising, in combination:

a fiberizer having a centrifuge member for receiving molten mineral material and centrifuging such mineral material to create a downwardly moving flow of mineral fibers;

a gathering member having a cone-shaped slope defining an angle of from about 10°-25° from the axial centerline of said gathering member for receiving such flow of mineral fibers, wherein said gathering member absorbs the energy of such mineral fiber flow to prevent reflection of such intercepted mineral fibers back into such downwardly moving veil and directs such mineral fibers into a transfer duct, wherein said mineral fibers are transported through said duct to a packaging machine.

7. An apparatus for manufacturing loose fibrous mineral material comprising, in combination:

a forehearth directing a flow of molten mineral material from a furnace to a plurality of fiberizers;

means for separating such flow of molten mineral material to each of said fiberizers wherein a majority of said fiberizers centrifuge such molten material into mineral fibers form forming an insulation pack and at least one of said fiberizers centrifuges such molten material into a downwardly moving veil of mineral fibers;

a gathering member for intercepting such downwardly moving veil, wherein said gathering member absorbs the energy of such downwardly moving veil to prevent reflection of such intercepted mineral fibers back into such downwardly moving veil and directs such mineral fibers into a duct; and, means for conveying such mineral fibers through such duct to a packaging machine.

8. The apparatus of claim 6, wherein said gathering member includes an inlet for receiving such flow of mineral fibers, said inlet being at least two times the diameter of such centrifuge member of said fiberizer.

9. The apparatus of claim 6, wherein said gathering member includes an inlet for receiving such flow of mineral fibers, an outlet leading to said transfer duct and a blowback chamber located between said inlet and said outlet.

10. The apparatus of claim 6, wherein said transfer duct includes at least one curved portion positioned downstream from said gathering member, said curved portion of said duct having a radius of curvature greater than or equal to 2.5 times the diameter of said duct.

* * * * *